US007404295B2

(12) United States Patent
Li et al.

(10) Patent No.: US 7,404,295 B2
(45) Date of Patent: Jul. 29, 2008

(54) ULTRA-LOW TEMPERATURE REGENERATOR AND REFRIGERATOR

(75) Inventors: Rui Li, Tokyo (JP); Takenori Numasawa, Ibaraki (JP)

(73) Assignees: Sumitomo Heavy Industries, Ltd., Tokyo (JP); National Institute for Materials Science, Ibaraki (JP)

( * ) Notice: Subject to any disclaimer, the term of this patent is extended or adjusted under 35 U.S.C. 154(b) by 445 days.

(21) Appl. No.: 10/508,432

(22) PCT Filed: Mar. 12, 2003

(86) PCT No.: PCT/JP03/02959

§ 371 (c)(1),
(2), (4) Date: Apr. 26, 2005

(87) PCT Pub. No.: WO03/081145

PCT Pub. Date: Oct. 2, 2003

(65) Prior Publication Data

US 2005/0223714 A1 Oct. 13, 2005

(30) Foreign Application Priority Data

Mar. 22, 2002 (JP) ..... 2002-081841

(51) Int. Cl.
*F25B 9/00* (2006.01)
*C99Z 99/00* (2006.01)
*F28D 17/00* (2006.01)
*F23L 15/02* (2006.01)

(52) U.S. Cl. ..... 62/6; 262/1; 165/4

(58) Field of Classification Search ..... 62/6; 252/1; 165/4

See application file for complete search history.

(56) References Cited

U.S. PATENT DOCUMENTS

| | | | | |
|---|---|---|---|---|
| 5,293,749 | A * | 3/1994 | Nagao et al. | 62/6 |
| 5,449,416 | A * | 9/1995 | Arai et al. | 148/301 |
| 6,003,320 | A * | 12/1999 | Okamura et al. | 62/6 |
| 6,336,978 | B1 * | 1/2002 | Tokai et al. | 148/301 |
| 7,226,543 | B2 * | 6/2007 | Takagimi et al. | 252/1 |

FOREIGN PATENT DOCUMENTS

| | | | |
|---|---|---|---|
| EP | 411591 | A2 * | 2/1991 |
| JP | 60-73267 | A * | 4/1985 |
| JP | 02-298765 | A * | 12/1990 |
| JP | 05-171139 | A | 7/1993 |
| JP | 050171139 | A * | 7/1993 |
| JP | 07-234030 | A * | 9/1995 |
| JP | 08-81220 | A * | 3/1996 |
| JP | 11-325628 | A * | 11/1999 |
| JP | 2001-336849 | A * | 12/2001 |
| JP | 2003-73661 | A * | 3/2003 |

OTHER PUBLICATIONS

International Search Report, mailed on Jun. 24, 2003.

* cited by examiner

*Primary Examiner*—William C Doerrler
(74) *Attorney, Agent, or Firm*—Rader, Fishman & Grauer, PLLC

(57) ABSTRACT

The refrigeration performance in a range from 3 to 10 K can be improved in comparison with conventional metal based magnetic regenerator materials.

The refrigerator is provided with a regenerator utilizing at least one magnetic material including a rare earth element and sulfur as the regenerator material.

30 Claims, 16 Drawing Sheets

ULTRA-LOW TEMPERATURE REGENERATOR AND REFRIGERATOR

TECHNICAL FIELD

The present invention relates to an ultra-low temperature regenerator and a refrigerator, and more particularly to an ultra-low temperature regenerator and a refrigerator that use a novel regenerator material to improve the refrigeration capabilities, and are ideally suited to use in GM (Gifford-McMahon) cycle refrigerators, Stirling cycle refrigerators, pulse tube refrigerators, Vuilleumier cycle refrigerators, Solvay cycle refrigerators, Ericsson cycle refrigerators, and refrigeration systems that use these refrigerators in a precooling stage, as well as a refrigeration system, a cryogen liquefaction apparatus, a cryogen recondensation apparatus, a superconducting magnet equipment, a superconducting device cooling equipment, a cryogenic panel, a cryogenic heat shield, and a cooling apparatus for use in the field of space technology that utilize this ultra-low temperature regenerator and refrigerator.

BACKGROUND ART

In conventional regenerator type ultra-low temperature refrigerators, the regenerator at the final cooling stage (the lowest temperature stage) is filled with a metal based magnetic regenerator material such as $Er_3Ni$ or $HoCu_2$ or the like, enabling cooling to be performed at 10 K or lower temperatures (Japanese Patent Laid-open Publication No. Hei 5-71816).

However, as shown by the example of $HoCu_2$ in FIG. 1, because these metal based magnetic regenerator materials do not have an adequately large specific heat in the vicinity from 4.2 K to 7 K, their refrigeration performance in the vicinity of 4.2 K is unsatisfactory. Furthermore, these metal based magnetic regenerator materials also suffer other problems in that the associated production costs are high, meaning they are not cheap.

DISCLOSURE OF THE INVENTION

The present invention aims to resolve the conventional problems described above, with an object of providing an ultra-low temperature regenerator and a refrigerator, which utilize a novel regenerator material that enables a large improvement in refrigeration performance from 3 to 10 K when compared with conventional metal based magnetic regenerator materials, as well as providing a refrigeration system that uses such an ultra-low temperature regenerator and refrigerator.

The present invention achieves the above object by using at least one type of magnetic material including a rare earth element and sulfur as the regenerator material within an ultra-low temperature regenerator.

Furthermore, the aforementioned magnetic material may also include oxygen.

Furthermore, the aforementioned magnetic material may use a material represented by either a general formula $R_xO_2S$ or a general formula $(R_{1-y}R'_y)_xO_2S$ (wherein, R and R' represent at least one type of rare earth element, $0.1 \leqq x \leqq 9$, and $0 \leqq y \leqq 1$).

Furthermore, the above elements R and R' may be selected from yttrium Y, lanthanum La, cerium Ce, praseodymium Pr, neodymium Nd, promethium Pm, samarium Sm, europium Eu, gadolinium Gd, terbium Tb, dysprosium Dy, holmium Ho, erbium Er, thulium Tm, and ytterbium Yb.

The volumetric specific heat values for $Gd_2O_2S$ and $Tb_2O_2S$, which represent examples of the magnetic material used in the present invention (the general formula $R_xO_2S$, wherein R is at least one type of rare earth element selected from the group consisting of Y, La, Ce, Pr, Nd, Pm, Sm, Eu, Gd, Tb, Dy, Ho, Er, Tm and Yb, and $0.1 \leqq x \leqq 9$) are shown in FIG. 1. For the purposes of comparison, the specific heat values for the conventional magnetic regenerator material $HoCu_2$, and a magnetic regenerator material $GdAlO_3$ disclosed in Japanese Patent Laid-open Publication No. 2001-317824 are also shown. The specific heat peak values for the $R_xO_2S$ materials are at least 2 to 3-fold that of $HoCu_2$. When compared with $GdAlO_3$, not only are the specific heat values greater for the $R_xO_2S$ materials, but the peak position for the specific heat falls within a range from 4 to 10 K, meaning the materials are ideal for obtaining good refrigeration performance at 3 to 10 K.

Furthermore, the volumetric specific heat values for $(Gd_yTb_{1-y})_2O_2S$ (y=0 to 1), which represent other examples of the magnetic material used in the present invention (the general formula $(R_{1-y}R'_y)_xO_2S$, wherein, R and R' represent at least one type of rare earth element, $0.1 \leqq x \leqq 9$, and $0 \leqq y \leqq 1$) are shown in FIG. 2. The specific heat values for $(Gd_yTb_{1-y})_2O_2S$ peak at 4 to 10 K, and the peak values is equal to, or more than, 0.6 $J/cm^3K$. In comparison, the peak value for the conventional magnetic regenerator material $HoCu_2$ is approximately 0.4 $J/cm^3K$. Any material of this composition is ideal for obtaining good refrigeration performance at 3 to 10 K.

In the present invention, the aforementioned magnetic material may further include an additive such as zirconium Zr, aluminum Al, or alumina ($Al_2O_3$)

Addition of an additive can be effective in improving the mechanical strength of a magnetic material used in the present invention. As shown in FIG. 3, addition of Al or Zr to $Gd_3O_2S$ (at a weight ratio of no more than 15% relative to the $Gd_2O_2S$) causes no significant variation in the temperature dependency of the specific heat, and the material is still ideal for obtaining good refrigeration performance at 3 to 10 K. On the other hand, by adding Al or Zr, the Pickers hardness, which indicates the hardness of the $Gd_2O_2S$, improved from approximately 400 to approximately 900, meaning that even if subjected to a heavy impact during use in a refrigerator, the likelihood of separation or powdering is reduced markedly. In those cases where alumina ($Al_2O_3$) is used as an additive, the weight ratio of the alumina relative to $Gd_2O_2S$ is preferably no more than 20%.

Furthermore, the present invention may also utilize a mixture of at least one type of the aforementioned magnetic material with another magnetic material.

In addition, the present invention may also utilize a mixture of at least two types of the aforementioned magnetic material.

Furthermore, at least one type of the aforementioned magnetic material may be preferably processed into granules with a size of 0.01 to 3 mm, and then used to fill a regenerator.

When the processed granules of a magnetic material described above are used in a refrigerator, in order to prevent separation or powdering occurring in the case of impact, the surface of the magnetic granule is preferably first coated with a thin film of thickness 1 μm to 50 μm, and then used to fill the refrigerator. The thin film is formed from a material such as alumina ($Al_2O_3$) or a fluororesin, to provide as high a level of heat transmission as possible, and is formed by a coating method or the like.

Furthermore, at least one type of the aforementioned magnetic material may be sintered and processed into blocks, pellets, or plates, and then used to fill the regenerator.

Furthermore, the aforementioned magnetic material may be formed in a layer when filling the regenerator.

Furthermore, the aforementioned magnetic material may be used to fill the lowest temperature layer of the regenerator.

Furthermore, the aforementioned magnetic material may be used in a higher temperature layer than the lowest temperature layer of the regenerator, and a different magnetic material with a large specific heat either in the vicinity of, or lower than 4 K may be used in the lower temperature layer.

The present invention also provides a regenerator type ultra-low temperature refrigerator that utilizes the aforementioned regenerator filled with the aforementioned magnetic material.

Furthermore, the present invention also provides a regenerator type ultra-low temperature refrigerator that utilizes the aforementioned regenerator filled with the aforementioned magnetic material in the lowest temperature cooling stage.

Furthermore, the aforementioned regenerator filled with the aforementioned magnetic material may also be used in an intermediate cooling stage, and a different magnetic material with a large specific heat either in the vicinity of, or lower than 4 K may be used in a regenerator of the final cooling stage.

Furthermore, the aforementioned regenerator filled with the aforementioned magnetic material may also be used in a lower temperature side cooling stage of a parallel system regenerator type ultra-low temperature refrigerator.

The present invention also provides the aforementioned regenerator type ultra-low temperature refrigerator that uses $^4$He, $^3$He, or a mixed gas of $^3$He and $^4$He as the operating fluid.

The present invention also provides a refrigeration system such as a Joule-Thomson refrigerator, a $^3$He-$^4$He dilution refrigerator, an adiabatic demagnetization refrigeration system, a magnetic refrigerator or an adsorption refrigerator, equipped with a precooling stage that uses the aforementioned regenerator type ultra-low temperature refrigerator, and at least one other cooling means.

Furthermore, the present invention also provides a cryogen liquefaction apparatus or a cryogen recondensation apparatus for liquid $^4$He, liquid $^3$He, a mixed liquid thereof, superfluid $^4$He, or superfluid $^3$He, which uses the aforementioned regenerator type ultra-low temperature refrigerator.

Furthermore, the present invention also provides a superconducting magnet equipment such as an MRI (magnetic resonance imaging) apparatus, an NMR apparatus, a refrigerator conduction cooling superconducting magnet, a single crystal pulling apparatus, a magnetic separation apparatus, a SMES device, or a physical properties measuring apparatus, which uses the aforementioned regenerator type ultra-low temperature refrigerator.

Furthermore, the present invention also provides a superconducting device cooling equipment for a SQUID device, a SIS element, an X-ray diffraction device, an electron microscope, or a voltage standard reference device, which uses the aforementioned regenerator type ultra-low temperature refrigerator.

Furthermore, the present invention also provides a low temperature device such as a cryopump, a cryopanel, a sample cooling system, a physical properties measuring apparatus, a low temperature heat shield device, or an infrared radiation measuring apparatus, which uses the aforementioned regenerator type ultra-low temperature refrigerator.

Furthermore, the present invention also provides a cooling apparatus for use in the field of space technology such as an X-ray measuring apparatus, an infrared radiation measuring apparatus, a radio wave measuring apparatus, or a cosmic ray measuring apparatus, which uses the aforementioned regenerator type ultra-low temperature refrigerator.

In the present invention, a ceramic magnetic material with a large specific heat in the vicinity of 4 to 10 K is used as the regenerator material for the regenerator. Accordingly, the refrigeration performance in a range from 3 to 10 K can be significantly improved in comparison with conventional metal based magnetic regenerator materials.

BEST MODE FOR CARRYING OUT THE INVENTION

As follows is a detailed description of embodiments of the present invention, with reference to the drawings.

Figure 1:
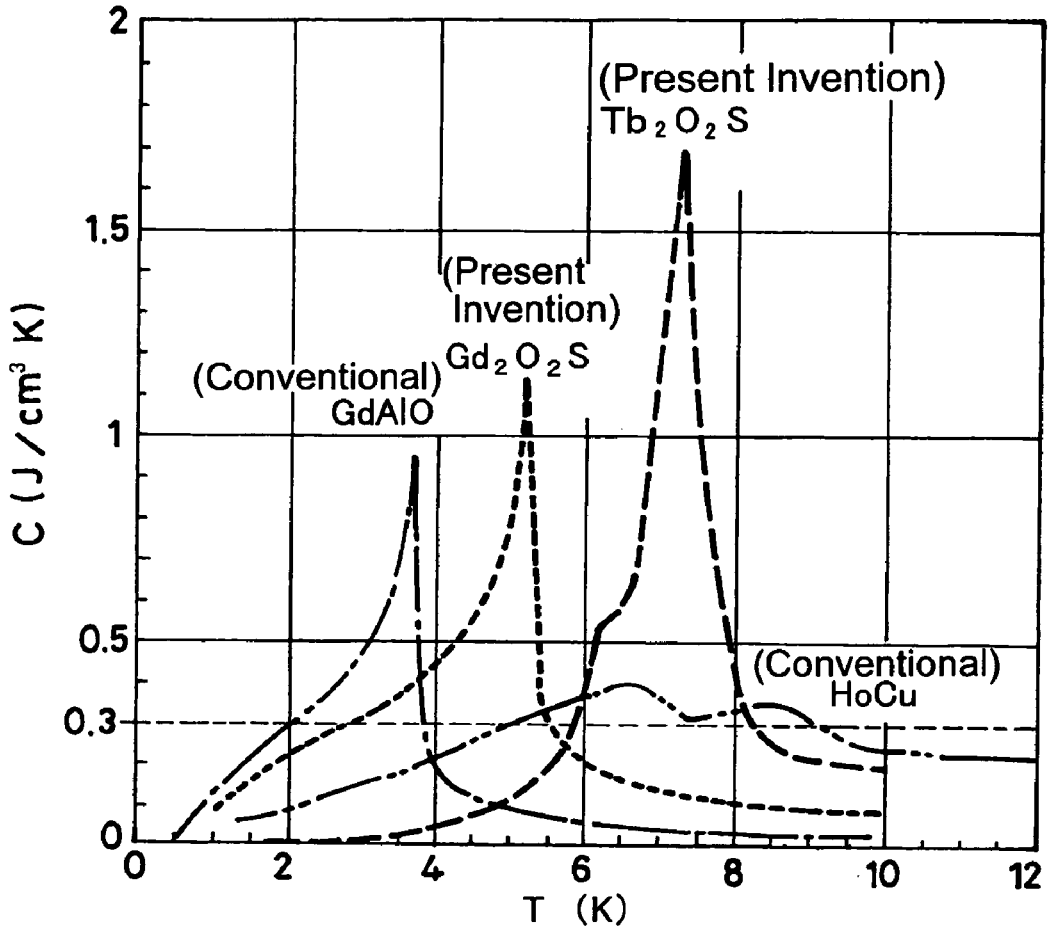
FIG. 1 is a diagram showing a comparison of the temperature dependency of the specific heat for conventional metal based magnetic regenerator materials, and magnetic materials used in the present invention.
Figure 2:
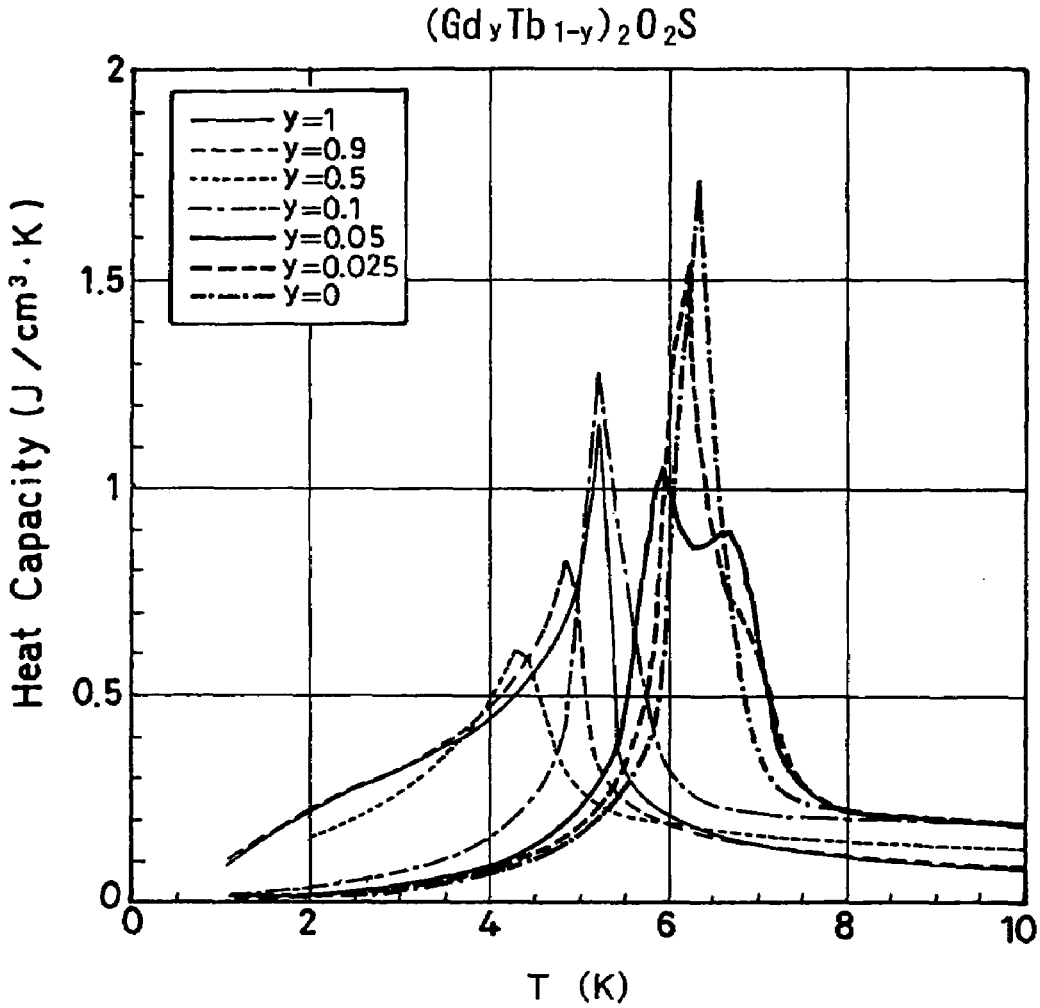
FIG. 2 is a diagram showing the temperature dependency of the specific heat for other magnetic materials used in the present invention.
Figure 3:
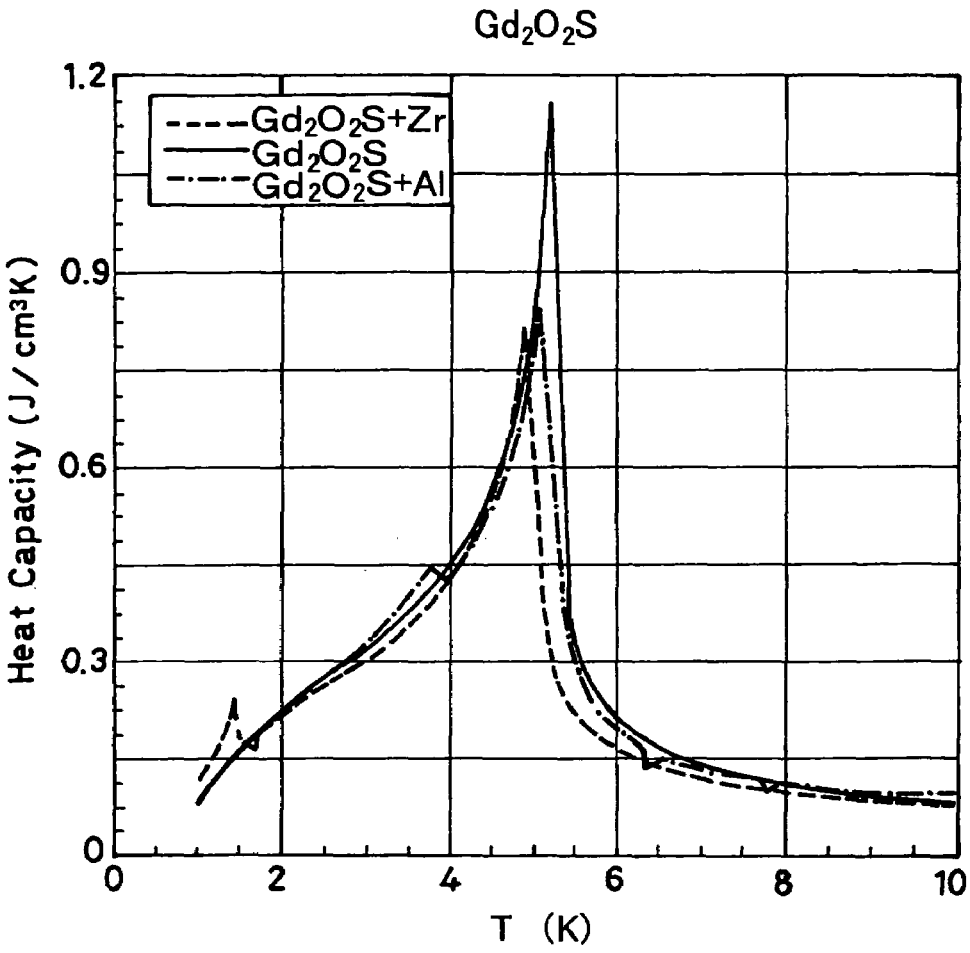
FIG. 3 is a diagram showing the temperature dependency of the specific heat for yet more magnetic materials used in the present invention.
Figure 4:
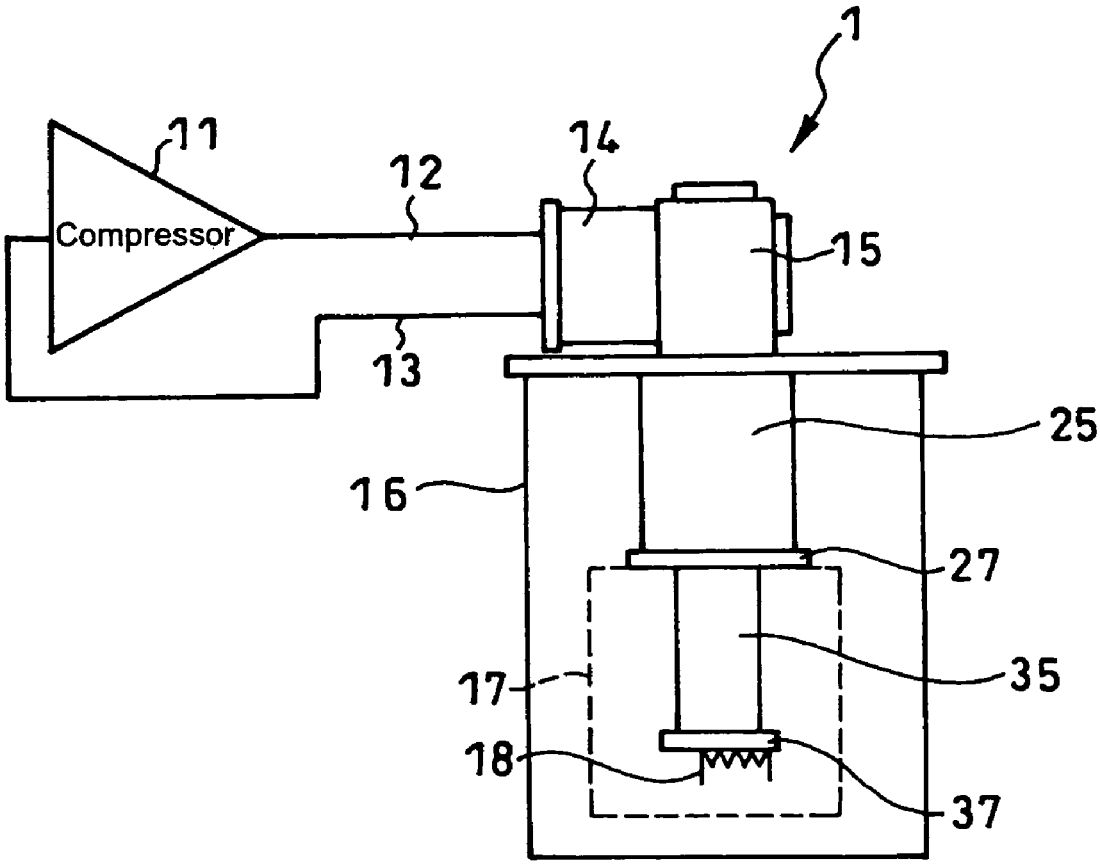
FIG. 4 is a cross-sectional view showing the overall configuration of a first embodiment of the present invention, which is applied to a two-stage GM refrigerator.
Figure 5:
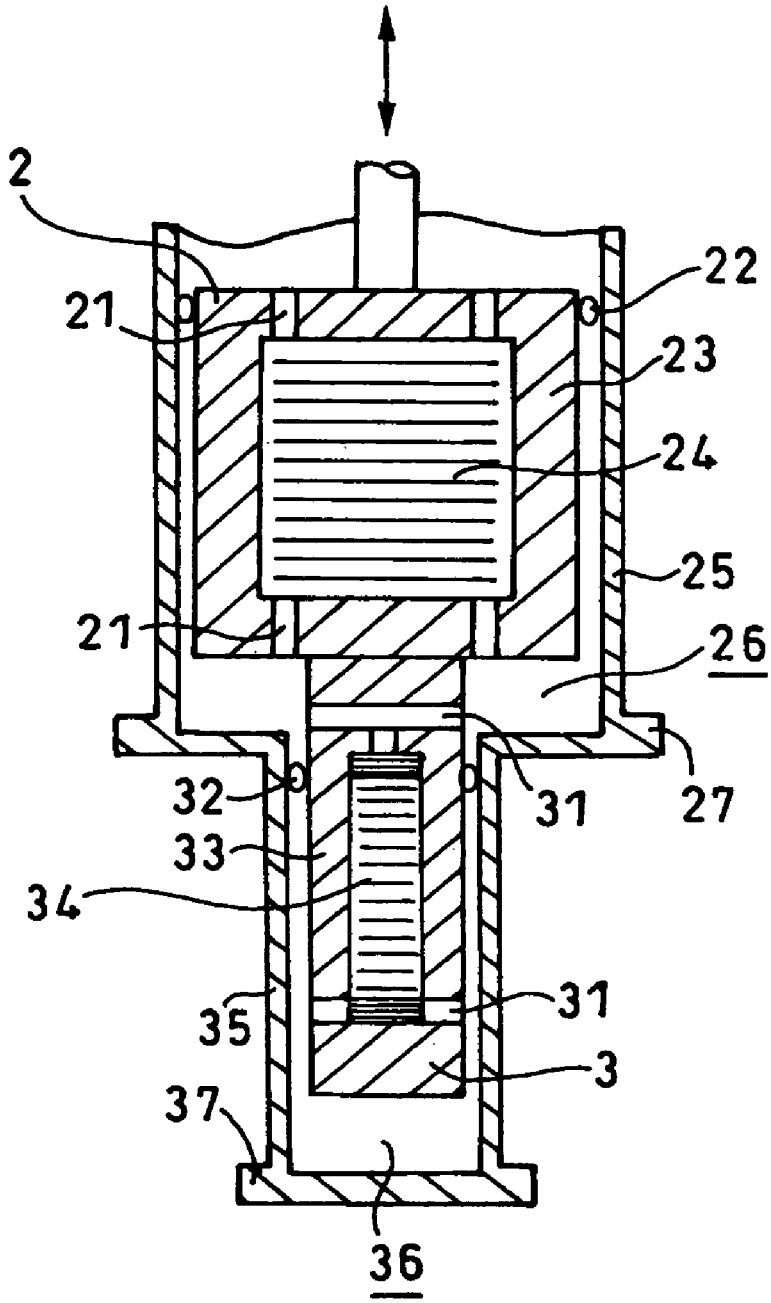
FIG. 5 is an enlarged sectional view showing details of the cooling section of the first embodiment.
Figure 6:
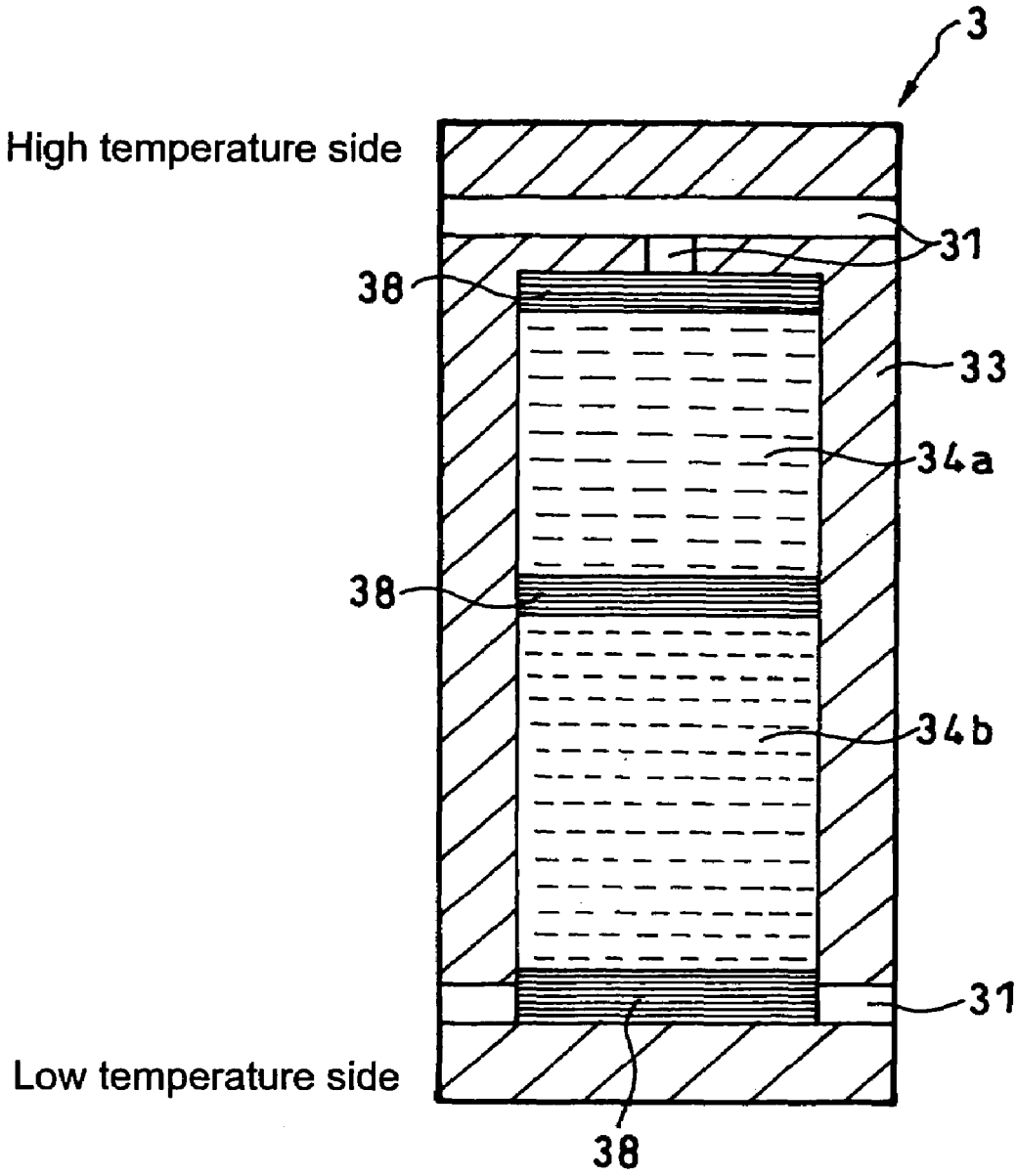
FIG. 6 is an enlarged sectional view showing a two-stage regenerator of the same embodiment.

As shown in FIG. 4 (an overall view), FIG. 5 (a detailed view of a cooling section), and FIG. 6 (a cross-sectional view of a two-stage regenerator), a first embodiment of the present invention involves the use of the present invention within a two-stage GM refrigerator.

In FIG. 4, high pressure gas from a compressor 11 is supplied to a two-stage GM refrigerator 1 through a high pressure gas line 12, and is recovered at a low pressure port of the compressor 11, through a low pressure gas line 13. As shown in FIG. 5, a first stage regenerator 2 and a second stage regenerator 3, housed within a first stage cylinder 25 and a second stage cylinder 35 respectively, are driven by a drive motor 14 shown in FIG. 4, and move up and down in a vertical direction.

As shown in FIG. 5, regenerator materials 24 and 34 are used to fill respective regenerator outer casings 23 and 33, and in this embodiment, the first stage regenerator material 24 is a wire mesh of a copper alloy.

As shown in FIG. 6, the second stage regenerator 3 has a layered structure, in which the second stage low temperature side regenerator material 34*b* utilizes granular $(Gd_{0.05}Tb_{0.95})_2O_2S$, filled with a volumetric ratio of approximately 20%, whereas the high temperature side regenerator material 34*a* utilizes granular Pb or $HoCu_2$ or the like, filled with a volumetric ratio of approximately 80%. In FIG. 6, the reference numeral 38 represents regenerator material partitions.

As shown in FIG. 4, the cooling section of the refrigerator 1 is housed in a vacuum vessel 16, and a second cooling stage 37 is surrounded by a heat shield 17. The heat shield 17 is a cylinder formed from copper plate, and is cooled to approximately 40 K by a first cooling stage 27. An electric heater 18 is attached to the second cooling stage 37, and the refrigeration performance is measured by supplying power to the heater.

In FIG. 4, the reference numeral 15 represents a housing that houses a high-low pressure gas switching valve and a drive mechanism, and in FIG. 5, the reference numeral 21 represents a gas passage for the first stage regenerator 2, 22 a seal for the same, 26 a first stage expansion space, 31 a gas passage for the second stage regenerator 3, 32 a seal for the same, and 36 a second stage expansion space.

Figure 7:
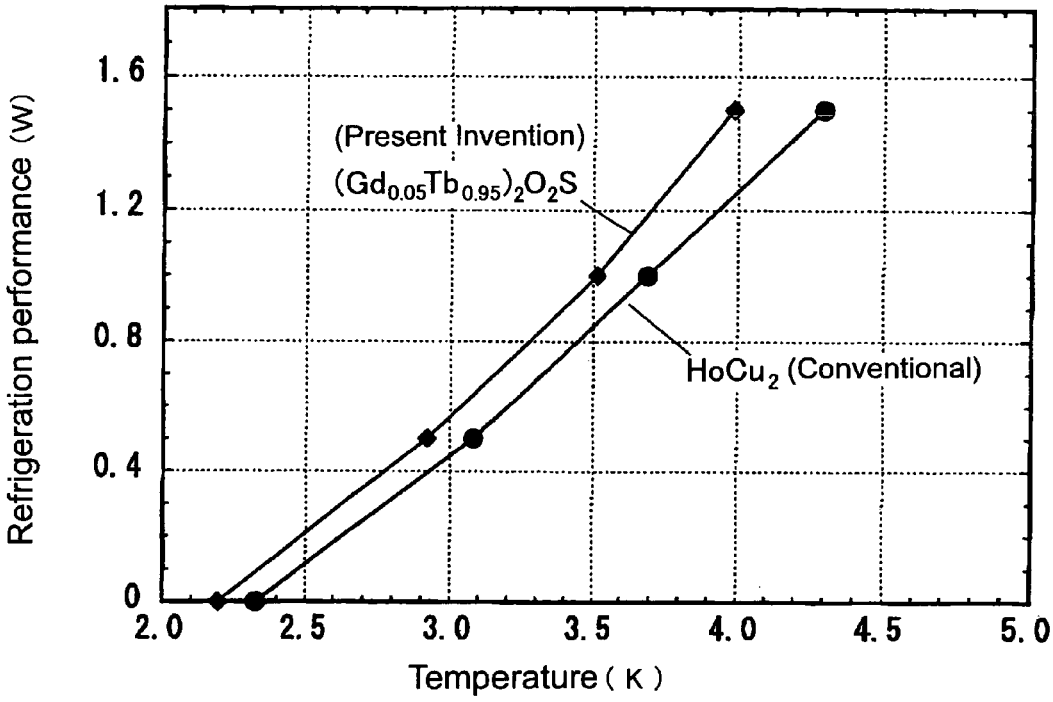
FIG. 7 is a diagram showing a comparison of the refrigeration performance of the first embodiment and a conventional example.

FIG. 7 shows a comparison of the cases where approximately 20% of the volume of the low temperature end of a second stage regenerator is either filled with $(Gd_{0.05}Tb_{0.95})_2O_2S$, according to the present invention, or filled with the conventional magnetic regenerator material $HoCu_2$. As is evident from the figure, the case in which the regenerator is filled with $(Gd_{0.05}Tb_{0.95})_2O_2S$ according to the present invention provides an improvement in refrigeration performance of approximately 15% to 20%.

Figure 8:
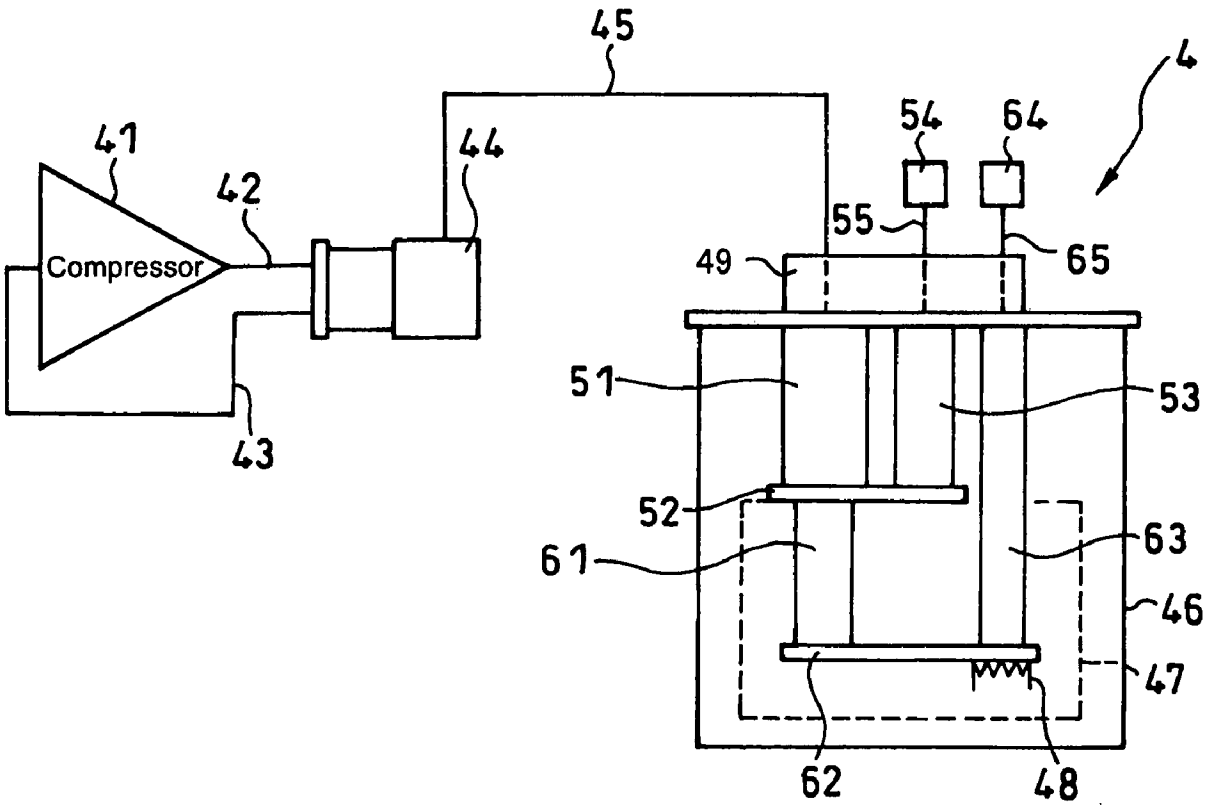
FIG. 8 is a cross-sectional view showing the overall configuration of second and third embodiments of the present invention, which are applied to a two-stage pulse tube refrigerator.
Figure 9:
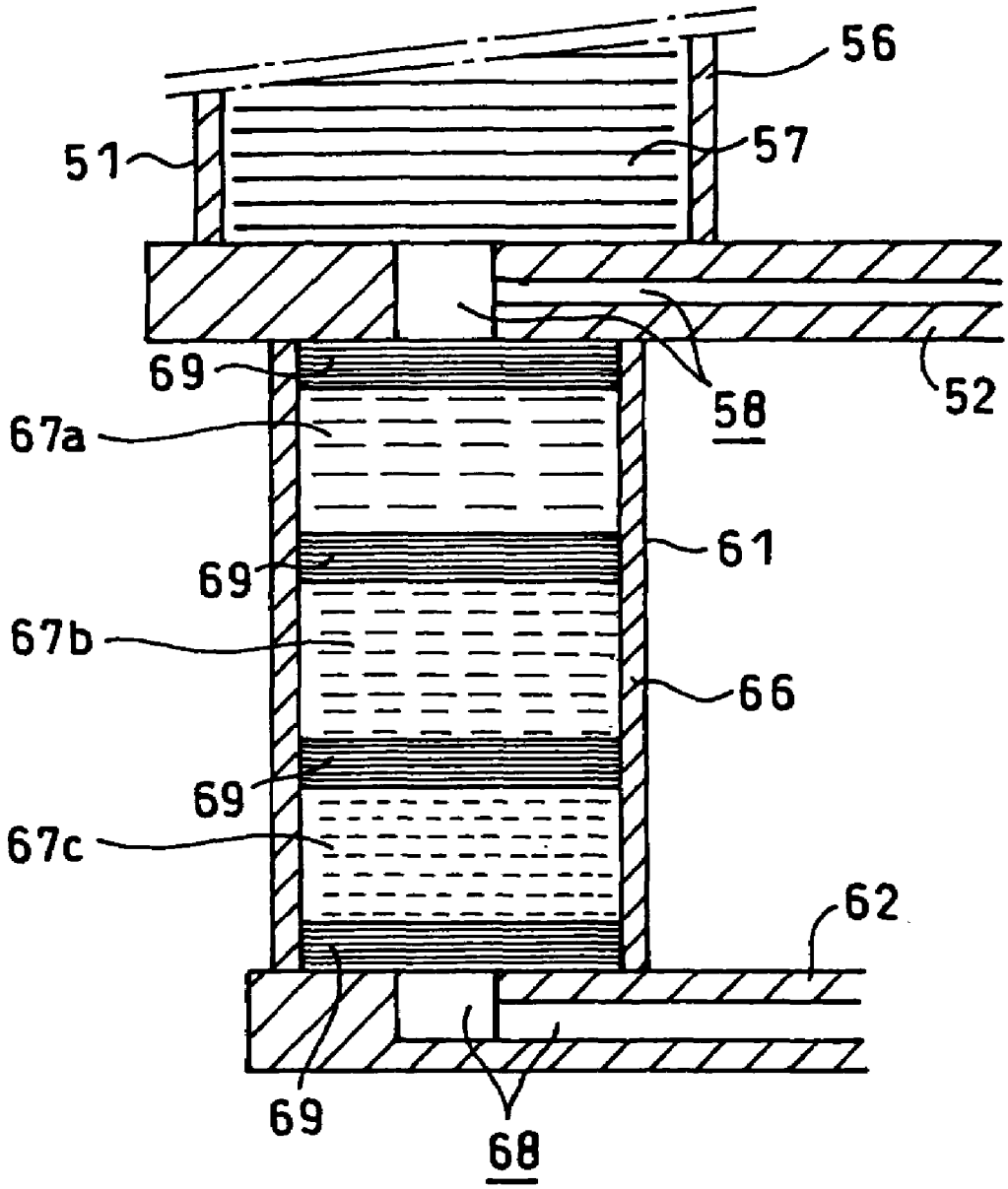
FIG. 9 is an enlarged sectional view showing a two-stage regenerator of the second and third embodiments.

A second embodiment of the present invention, applied to a two-stage pulse tube refrigerator, is shown in FIG. 8 (an overall view) and FIG. 9 (a cross-sectional view of a second stage regenerator).

In FIG. 8, high pressure gas from a compressor 41 is supplied to a two-stage pulse tube refrigerator 4 through a high pressure gas line 42, a high-low pressure gas switching valve unit 44, and a connection line 45, and is recovered at a low pressure port of the compressor 41, through a low pressure gas line 43 and the same valve unit 44. As shown in FIG. 9, a first stage regenerator 51 and a second stage regenerator 61 comprise, respectively, regenerator outside pipes (stainless steel pipe) 56 and 66, and regenerator materials 57 and 67 filled therein.

The low temperature ends of the respective regenerators 51 and 61 are connected to respective cooling stages 52 and 62, and are connected through to respective pulse tubes 53 and 63 of the stages, via gas passages 58 and 68 respectively provided inside the cooling stages 52 and 62 of the respective stages. Phase adjustment sections 54 and 64 for the respective stages are connected to the high temperature ends of the pulse tubes 53 and 63 via connection lines 55 and 65, respectively.

The phase adjustment sections 54 and 64 of the respective stages are each formed from a combination of a buffer tank or orifice, or a valve that opens and closes periodically. The phase adjustment sections 54 and 64 enable the phase between the pressure variation within the pulse tubes 53 and 63 realized by the high-low pressure gas switching valve unit 44, and the displacement of the gas, to be adjusted to an optimal value, thereby ensuring a satisfactory refrigeration performance.

In this embodiment, the first stage regenerator material 57 is a wire mesh (mesh No. 100 to 400) of a copper alloy.

The second stage regenerator 61 is a layered structure with three layers, in which the high temperature side regenerator material 67*a* is filled with granular lead (granule diameter 0.1 to 1 mm) with a volumetric ratio of approximately 20%, the intermediate regenerator material 67*b* is filled with granular $HoCu_2$ (granule diameter 0.1 to 0.7 mm), and the low temperature side regenerator material 67*c* is filled with granular $Gd_2O_2S$ (granule diameter 0.1 to 0.7 mm). In FIG. 9, the reference numeral 69 represents regenerator material partitions.

As shown in FIG. 8, the cooling section of the refrigerator 4 is housed in a vacuum vessel 46, and the second cooling stage 62 is surrounded by a heat shield 47. The heat shield 47 is a cylinder formed from copper plate, and is cooled to approximately 40 K by the first cooling stage 52. An electric heater 48 is attached to the second cooling stage 62, and the refrigeration performance is measured by supplying power to the heater. In FIG. 8, the reference numeral 49 represents a housing.

Figure 10:
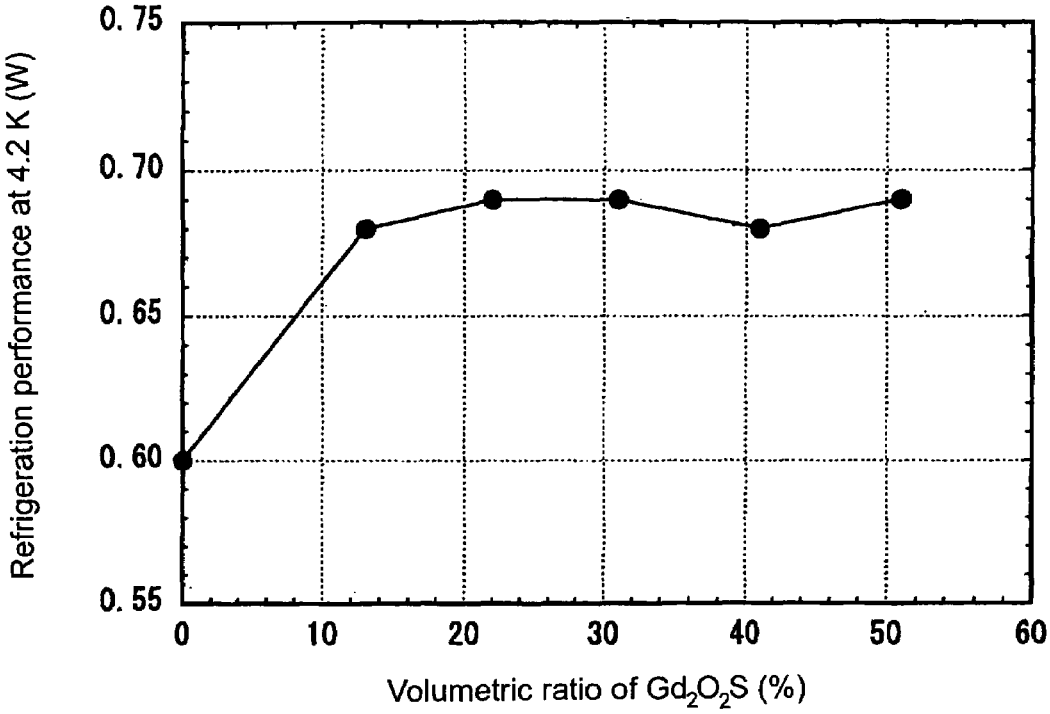
FIG. 10 is a diagram showing the refrigeration performance of the second embodiment.

FIG. 10 shows the refrigeration performance at 4.2 K, when the $Gd_2O_2S$ of the low temperature side regenerator material 67*c* of the second stage regenerator 61 is increased from 0% to approximately 50% (volumetric ratio), and the $HoCu_2$ of the intermediate regenerator material 67*b* is correspondingly reduced from 80% to 30% (and the volumetric ratio for the lead of the high temperature side regenerator material 69*a* is fixed at 20%). The refrigeration performance improved approximately 15%.

In this embodiment, the regenerator materials 57 and 67 of respective stages are filled directly inside the regenerator outside pipes 56 and 66, respectively, although in order to simplify the assembly and disassembly operations, the regenerator material may also be first used to fill a regenerator outer casing (formed from a material with low thermal conductivity such as a resin or stainless steel), and then inserted inside the regenerator outside pipe 56, 66 in a cartridge form, as in the first embodiment.

Next is a detailed description of a third embodiment of the present invention, which like the second embodiment is applied to a two-stage pulse tube refrigerator.

This embodiment uses the same two-stage pulse tube refrigerator 4 as the second embodiment. The point of difference from the second embodiment is the configuration of the second stage regenerator 61. The second stage regenerator 61 in this embodiment is also a three layered structure, but granular lead (volumetric ratio 50%, granule diameter 0.1 to 1 mm) is used to fill the high temperature layer (67*a*), a granular magnetic material of the present invention $Tb_2O_2S$ (volumetric ratio 30%, granule diameter 0.1 to 0.7 mm) is used to fill the intermediate layer (67*b*), and granular $GdAlO_3$ (volumetric ratio 20%, granule diameter 0.1 to 0.6 mm) is used to fill the low temperature layer (67*c*).

Because the specific heat peak for $GdAlO_3$ is equal to, or lower than, 4 K, this embodiment enables the refrigeration performance to be further improved in the range from 2 to 4 K.

Figure 11:
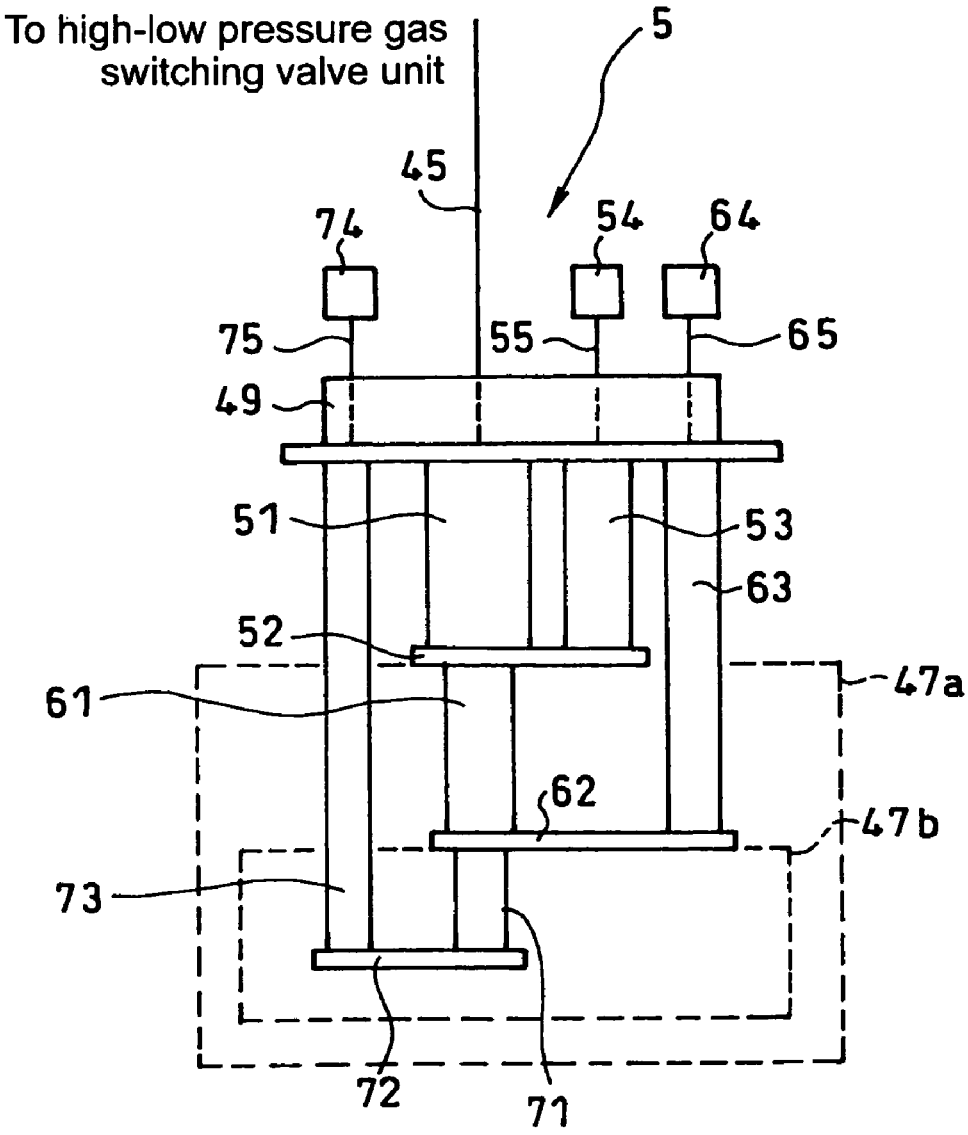
FIG. 11 is a cross-sectional view showing the overall configuration of a fourth embodiment of the present invention, which is applied to a 3 stage pulse tube refrigerator.
Figure 12:
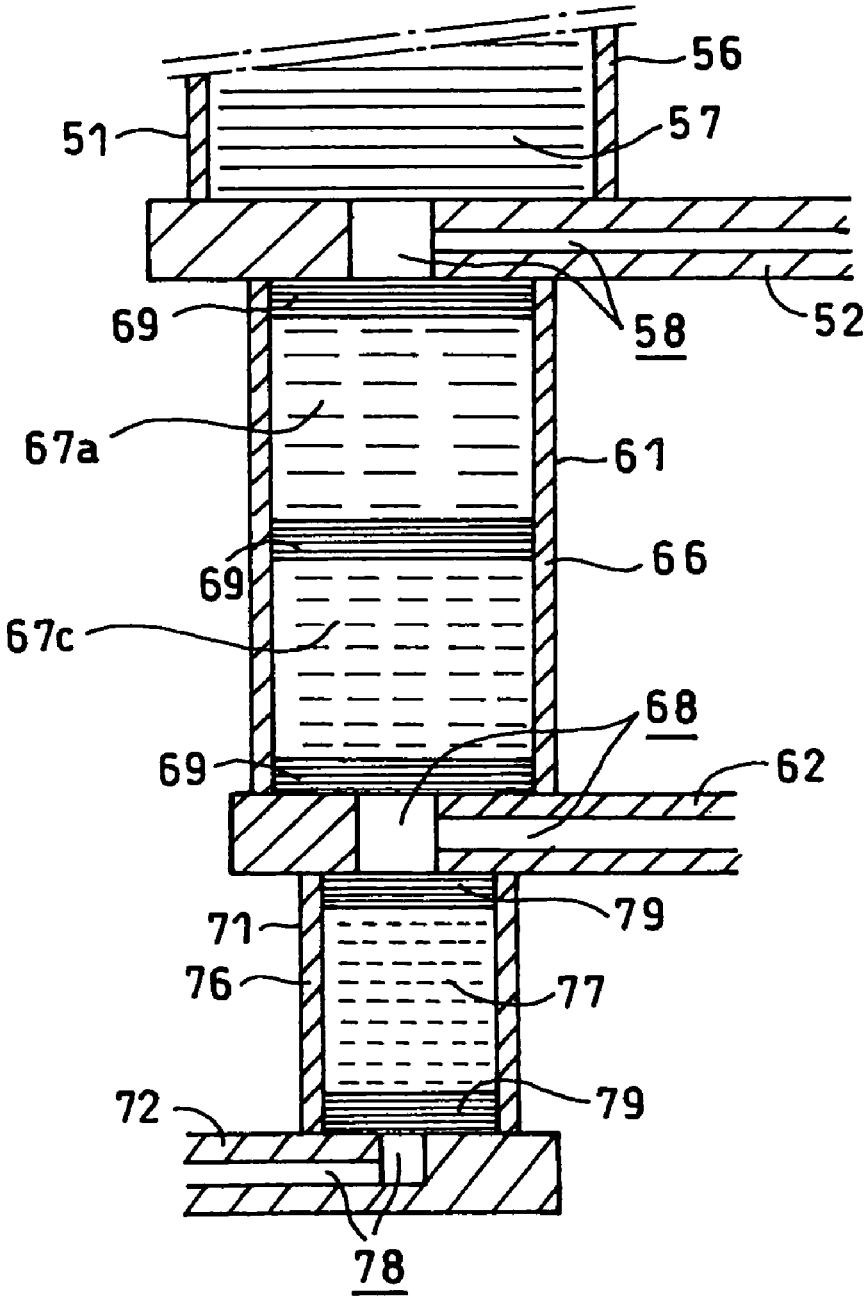
FIG. 12 is an enlarged sectional view showing the regenerator of each stage of the fourth embodiment.

A fourth embodiment of the present invention, applied to a 3-stage pulse tube refrigerator, is shown in FIG. 11 (a cross-sectional view of the refrigerator) and FIG. 12 (a cross-sectional view of the regenerators of each stage).

The 3-stage pulse tube refrigerator 5 of this embodiment is essentially the same as the pulse tube refrigerator 4 of the second embodiment, with the points of difference being that a third stage regenerator 71 is connected directly to the end of the second stage regenerator 61, and the fact that the low temperature end of this third stage regenerator 71 is connected to the low temperature end of a third stage pulse tube 73 via a third cooling stage 72. The construction of the third stage regenerator 71, the third cooling stage 72, the third stage pulse tube 73, and a third stage phase adjustment section 74, which is connected via a connection line 75, are the same as the equivalent components in the first and second stages of the second embodiment. In FIG. 12, the reference numeral 76 represents a third stage regenerator outside pipe, 77 a third stage regenerator material, 78 a gas passage inside the third cooling stage 72, and 79 regenerator material partitions.

In this embodiment, the first stage regenerator material 57 is a wire mesh (mesh No. 100 to 400) of stainless steel.

The second stage regenerator 61 is a two layered structure, in which the high temperature side regenerator material 67*a* is filled with granular lead, with a volumetric ratio of 60%, and the low temperature side regenerator material 67*c* utilizes pellets of a magnetic material $(Gd_{0.1}Tb_{0.9})_2O_2S$ according to the present invention, which are filled with a volumetric ratio of 40%. The third stage regenerator 71 is filled with $GdAlO_3$ (in pellet form), which has a specific heat peak of 4 K or lower, with a volumetric ratio of 100%. This embodiment enables the refrigeration performance within the range from 2 to 4 K to be further improved.

In this embodiment, pellets of $(Gd_{0.1}Tb_{0.9})_2O_2S$ and $GdAlO_3$ were used, and although materials in the form of sintered pellets make dimensional control and adapting to variations in the shape of the regenerators more difficult than is the case with granular materials, they offer the advantage of enabling higher filling factors.

Figure 13:
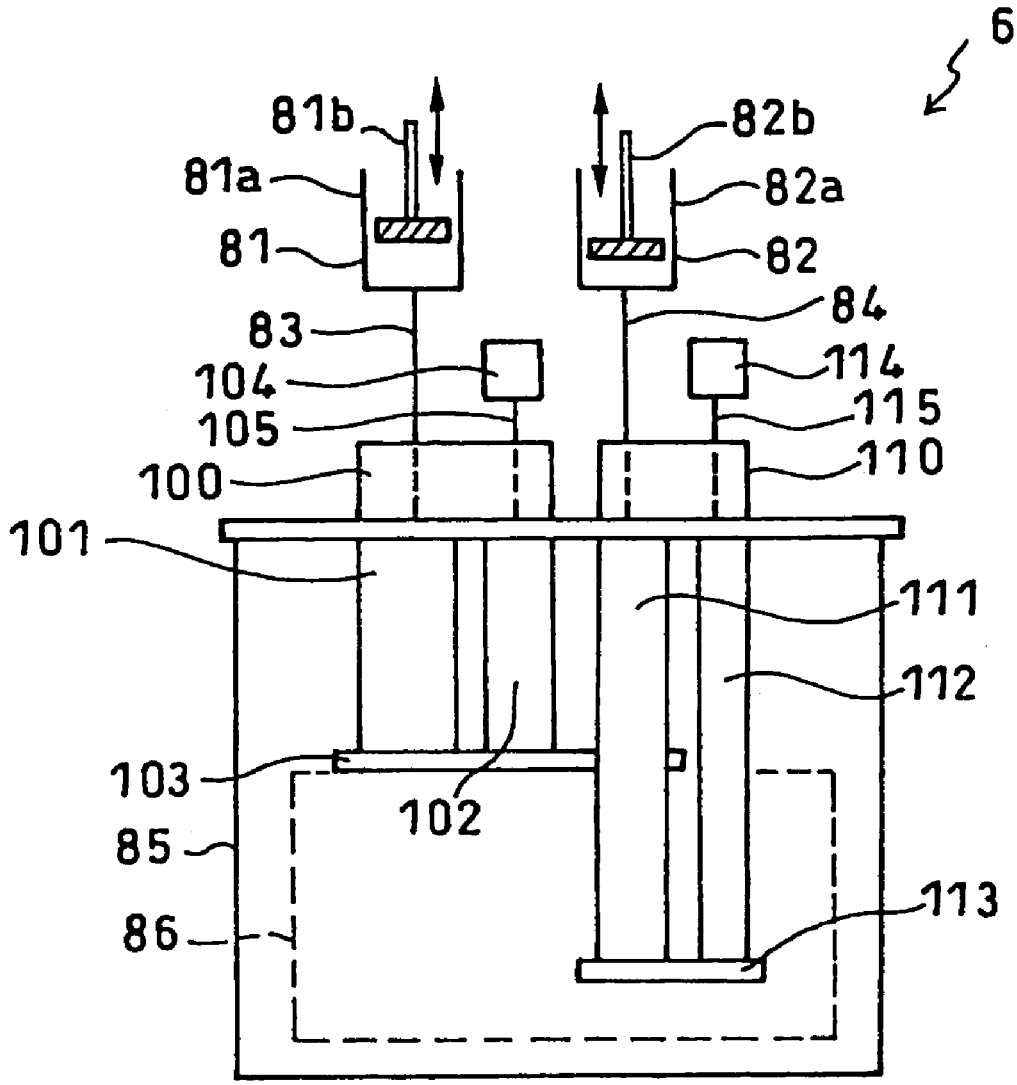
FIG. 13 is a cross-sectional view showing the overall configuration of a fifth embodiment of the present invention, which is applied to a parallel system pulse tube refrigerator.
Figure 14:
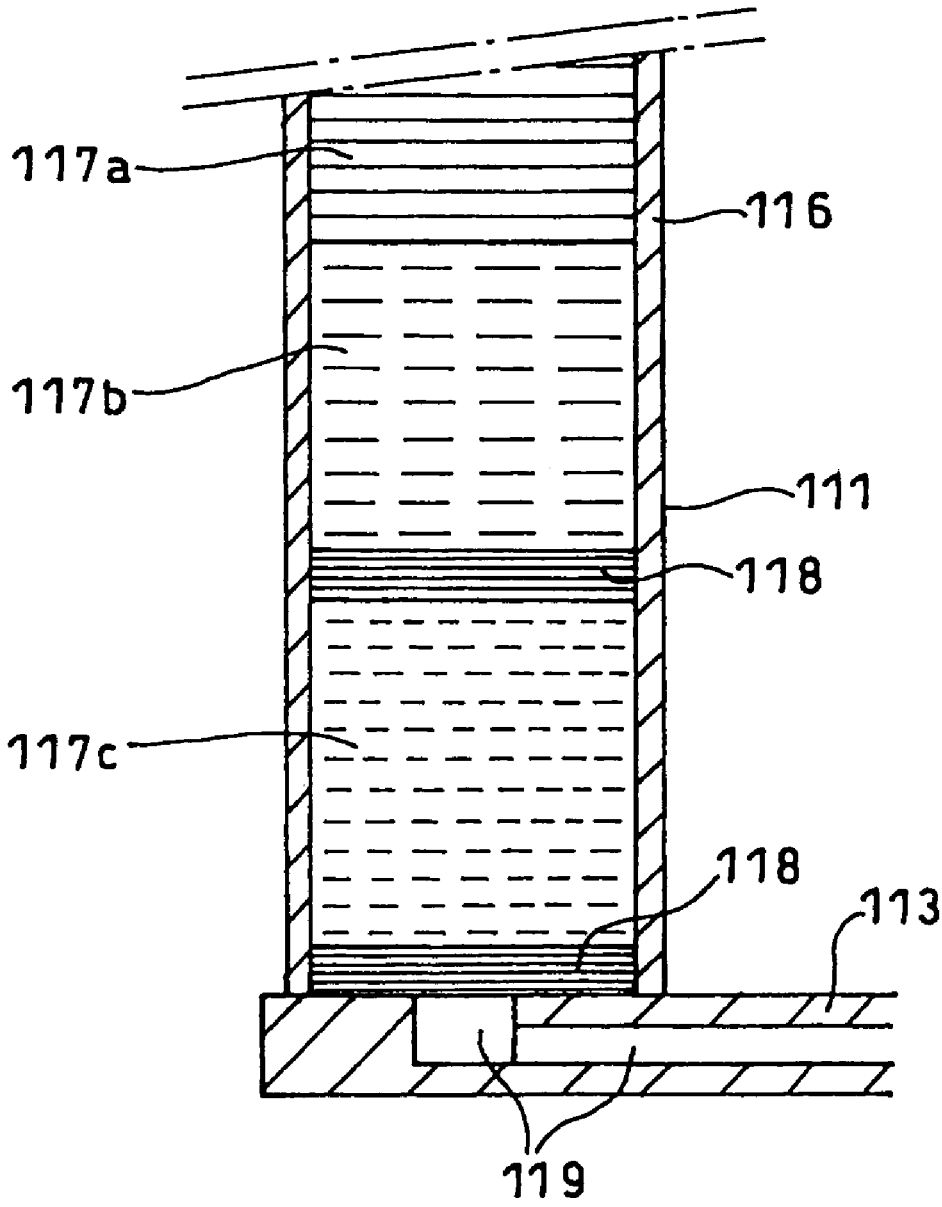
FIG. 14 is an enlarged sectional view showing a low temperature stage regenerator of the fifth embodiment.

A fifth embodiment of the present invention, applied to a parallel system pulse tube refrigerator, is shown in FIG. 13 (a cross-sectional view of the refrigerator) and FIG. 14 (a cross-sectional view of the low temperature stage regenerator)

In a parallel system pulse tube refrigerator, a plurality of mutually independent one-stage or two-stage pulse tube refrigerators are coupled together thermally, thereby forming a high temperature stage and a low temperature stage, and performing the role of a single multi-stage refrigerator. In the parallel system pulse tube refrigerator 6 of this embodiment, two independent one-stage pulse tube refrigerators are coupled together thermally, forming a high temperature cooling stage 103 and a low temperature cooling stage 113, and in effect, thus performing the role of a single two-stage pulse tube refrigerator. In this type of parallel system refrigerator, because the gas flows within the high temperature stage and the low temperature stage are independent, variations in temperature or refrigeration performance at one cooling stage is less likely to affect the other cooling stage, and consequently, a more stable cooling system can be realized.

In this embodiment, the high temperature cooling stage 103 cools a heat shield 86, while also cooling the midpoint of a low temperature stage regenerator 111. This enables an improvement in the efficiency of the low temperature regenerator 111, and as a result, enables the low temperature stage to reach an even lower temperature. Furthermore, in this embodiment, compressors 81, 82 use cylinder (81*a*, 82*b*)-piston (81*b*, 82*b*) type compressors that are different from the previous embodiments. Accordingly, high-low pressure oscillations can be sent directly to the pulse tubes 102 and 112 without using a high-low pressure gas switching valve unit. In FIG. 13, the reference numerals 83 and 84 represent compressor connection lines, 85 a vacuum vessel, 100 and 110 housings, 101 a high temperature stage regenerator, 104 and 114 phase adjustment sections, and 105 and 115 connection lines.

As shown in FIG. 14, the low temperature stage regenerator 111 of the present embodiment is a layered structure with three layers, in which the regenerator material 117*a* on the high temperature side from room temperature is filled with a wire mesh (mesh No. 100 to 400, volumetric ratio 50%) of a copper alloy, the intermediate regenerator material 117*b* is filled with granular lead alloy (volumetric ratio 30%, granule diameter 0.1 to 1 mm), and the low temperature side regenerator material 117*c* is filled with a mixture of granular $Tb_2O_2S$ and $Gd_2O_2S$ (mixing ratio 60%:40%) (volumetric ratio 20%, granule diameter 0.1 to 0.7 mm). This construction enables good refrigeration performance to be achieved within the temperature range from 4 to 10 K at the low temperature cooling stage 113. In FIG. 14, the reference numeral 116 represents a low temperature stage regenerator outside pipe, 118 regenerator material partitions, and 119 a gas passage inside the low temperature cooling stage 113.

In this embodiment, separate compressors 81 and 82 were used for the high temperature stage and the low temperature stage pulse tubes 102 and 112, respectively, but in order to simplify the system configuration, gas supply to, and gas recovery from the two parallel pulse tubes may also be conducted simultaneously using a single compressor.

Furthermore, in this embodiment, a mixed material of $Tb_2O_2S$ and $Gd_2O_2S$ was used, and by using this type of mixed material, the apparent specific heat peak value falls, but a larger apparent specific heat can be obtained across a wider temperature range, and as a result, the number of layers within the layered structure can be reduced. If the number of layers within the layered structure increase too much, then not only does the space occupied by the regenerator material partitions increase, but the chances of a partition collapsing, inviting a destabilization of the refrigeration performance, also increase. By using a mixed material, these types of drawbacks can be resolved.

Figure 15:
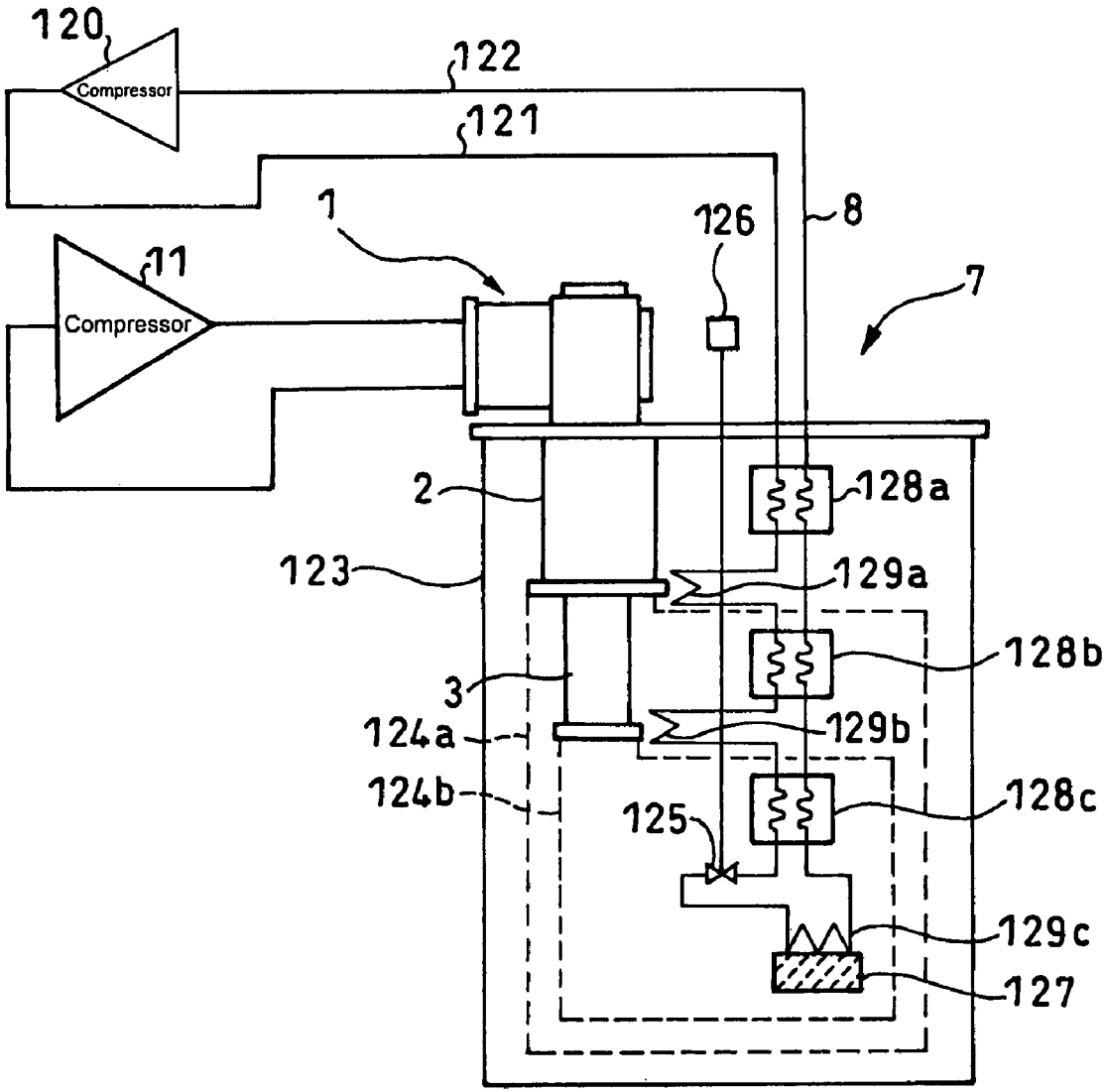
FIG. 15 is a cross-sectional view showing the overall configuration of a sixth embodiment of the present invention, which is applied to a GM-JT refrigeration system.

A sixth embodiment of the present invention, which uses the two-stage GM refrigerator 1 of the first embodiment in a precooling stage, and also includes an additional Joule-Thomson (JT) cooling circuit 8 as another cooling device, is shown in FIG. 15.

The two-stage GM refrigerator 1 is the same as that of the first embodiment, and so the description is omitted here, although the lowest temperature stage of the second stage regenerator 3 was filled with a regenerator material of the present invention $(Gd_{0.05}Tb_{0.95})_2O_2S$, with a volumetric ratio of 20%.

In the additional JT cooling circuit 8, helium gas flows from a compressor 120, through a high pressure line 121, and then passes sequentially through a first counterflow heat exchanger 128*a*, a first stage interstage heat exchanger 129*a*, a second counterflow heat exchanger 128*b*, a second stage interstage heat exchanger 129*b*, and a third counterflow heat exchanger 128*c*, while undergoing gradual precooling. When the precooled gas passes through a JT valve 125 (the optimal opening is adjusted using an adjustment handle 126), it undergoes a constant enthalpy expansion, causing cooling, and when it passes through a heat exchanger 129*c*, heat is removed from the cooling target material 127, causing cooling of the material.

In addition, as the gas passes through the counterflow heat exchangers 128*a*, 128*b* and 128*c*, gas entering in the opposite direction is cooled, and then passes through a low pressure line 122 and is recovered by the compressor 120.

In FIG. 15, the reference numeral 123 represents a vacuum vessel, and 124*a* and 124*b* heat shields.

In this embodiment, the refrigeration performance of the GM refrigerator 1 is improved approximately 20% by using the magnetic material of the present invention, meaning the flow rate of gas flowing through the JT cooling circuit 8 can be increased, and as a result, the ability to cool the cooling target material 127 at the heat exchanger 129*c* can be improved by approximately 10 to 20%.

Figure 16:
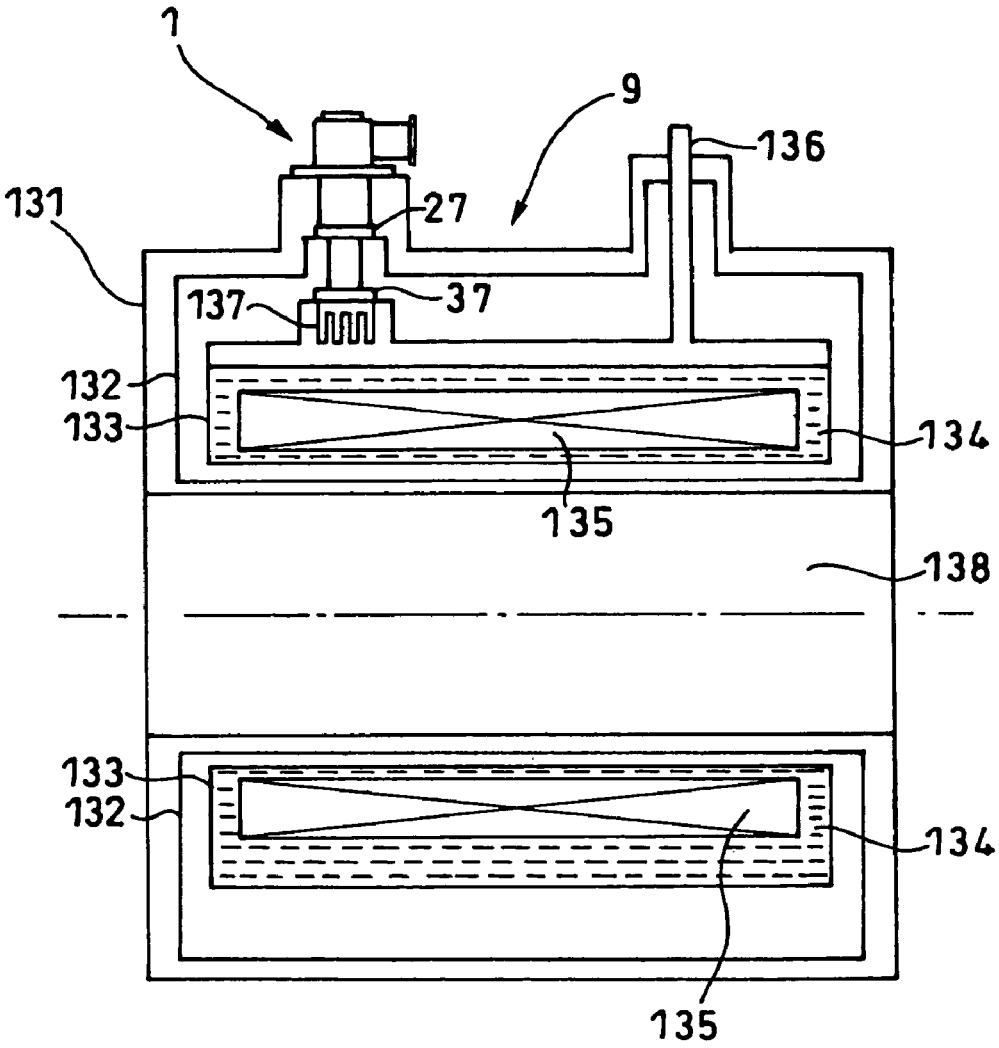
FIG. 16 is a cross-sectional view showing the overall configuration of a seventh embodiment of the present invention, which is applied to an MRI apparatus.

A seventh embodiment of the present invention, which is a magnetic resonance imaging (MRI) apparatus that also uses the same two-stage GM refrigerator 1 of the first embodiment, is shown in FIG. 16.

In the MRI apparatus 9 of this embodiment, a superconducting magnet 135 is used to generate a magnetic field space 138. The superconducting magnet 135 is immersed in liquid helium 134, and cooled to a state of superconductivity. A heat shield 132 is provided outside a liquid helium container 133, and a vacuum vessel 131 encloses the heat shield. The liquid helium is injected through an injection inlet 136, and gasified helium is returned to liquid form by a condenser section 137 provided inside the liquid helium container 133, enabling operation to be conducted for extended periods without replenishment of the helium.

The condenser section 137 is coupled thermally to the second cooling stage 37 of the GM refrigerator 1, and provides continuous cooling. The first cooling stage 27 of the GM refrigerator 1 cools the heat shield 132.

In this embodiment, the refrigeration performance of the GM refrigerator 1 is improved approximately 20% by using a magnetic material of the present invention, meaning the recondensation of the liquid helium 134 can be conducted more efficiently, and enabling this type of configuration to be applied to an MRI apparatus with a larger level of helium evaporation.

In the present embodiment, the refrigerator 1 was used for recondensing the liquid helium 134, but a different configuration could also be used, in which the liquid helium is eliminated, and the refrigerator 1 cools the superconducting magnet 135 directly by thermal conduction. Furthermore, an additional heat shield could also be added, and a so-called shield cooling type configuration adopted, in which the first cooling stage 27 and the second cooling stage 37 each cool one of the heat shields.

In the above embodiments, the general formula of the magnetic material was either $R_xO_2S$ or $(R_{1-y}R'_y)_xO_2S$ (wherein, R and R' represent rare earth elements), but the magnetic material is not necessarily restricted to these formulas, and for example, a material containing no oxygen $O_2$ can also be used.

The aforementioned magnetic material can be used either alone, or in combination with another magnetic material. Furthermore, mixtures of at least two of the aforementioned magnetic materials can also be used.

Furthermore, the aforementioned magnetic material can also be processed into granules (0.01 mm to 3 mm) and then used to fill a regenerator. When granules are used, adapting to variations in the shape of the regenerator is easier, making dimensional control of the regenerator easier to handle. Alternatively, the magnetic material can also be sintered and processed into blocks, pellets, or plates. In this case, the filling factor of the regenerator material can be improved by suitably adjusting the shape of the magnetic material.

The operating fluid for the regenerator type refrigerator can use $^4$He, $^3$He, a mixed gas thereof, or another fluid.

In the above embodiments, the present invention was applied to a GM cycle refrigerator, a pulse tube refrigerator, and a Joule-Thomson refrigerator, but the present invention is not restricted to these applications, and can naturally also be applied to other regenerator type ultra-low temperature refrigerators such as Stirling cycle refrigerators, Vuilleumier cycle refrigerators, Solvay cycle refrigerators, and Ericsson cycle refrigerators.

Furthermore, refrigeration systems that utilize a regenerator type ultra-low temperature refrigerator according to the present invention in a precooling stage are not restricted to the Joule-Thomson refrigerator of the sixth embodiment, and can naturally also be similarly applied to other refrigeration systems such as $^3$He-$^4$He dilution refrigerators, adiabatic demagnetization refrigeration systems, magnetic refrigerators, and adsorption type refrigeration systems.

Furthermore, in addition to refrigeration systems, the present invention can also be applied to cryogen liquefaction apparatus or cryogen recondensation apparatus for liquid $^4$He, liquid $^3$He, a mixed liquid thereof, superfluid $^4$He, or superfluid $^3$He, which can use the aforementioned regenerator type ultra-low temperature refrigerator.

Furthermore, the present invention can also be similarly applied to other superconducting magnet equipment such as MRI apparatus, NMR apparatus, refrigerator conduction cooling superconducting magnets, single crystal pulling apparatus, magnetic separation apparatus, SMES devices, and physical properties measuring apparatus.

Furthermore, the present invention can also be similarly applied to superconducting device cooling equipment for SQUID devices, SIS elements, X-ray diffraction devices, electron microscopes, or voltage standard reference devices.

Furthermore, the present invention can also be similarly applied to low temperature devices such as cryopumps, cryopanels, sample cooling systems, physical properties measuring apparatus, low temperature heat shields, and infrared radiation measuring apparatus.

Furthermore, the present invention can also be similarly applied to cooling apparatus for use in the field of space technology such as X-ray measuring apparatus, infrared radiation measuring apparatus, radio wave measuring apparatus, and cosmic ray measuring apparatus.

INDUSTRIAL APPLICABILITY

According to the present invention, because a regenerator material utilizes a magnetic material with a larger specific heat than conventional metal based magnetic regenerator materials for the temperature range from 4 to 10 K, the heat exchange efficiency with operating gases such as helium improves, enabling an improvement in the refrigeration performance.

The invention claimed is:

1. An ultra-low temperature regenerator characterized in that at least one type of magnetic material including a rare earth element and sulfur is used as regenerator materials, wherein said magnetic material includes oxygen and wherein said magnetic material uses a material represented by a formula $(R_{1-y}R'_y)_xO_2S$ where R represents a first rare earth element and R' represent a second rare earth element being different from the first rare earth element with x being selected from a range defined as $0.1 \leqq x \leqq 9$, and y being selected from a range defined as $0<y<1$.

2. The ultra-low temperature regenerator according to claim 1, wherein said elements R and R' are selected from yttrium Y, lanthanum La, cerium Ce, praseodymium Pr, neodymium Nd, promethium Pm, samarium Sm, europium Eu, gadolinium Gd, terbium Tb, dysprosium Dy, holmium Ho, erbium Er, thulium Tm, and ytterbium Yb.

3. The ultra-low temperature regenerator according to claim 1, wherein said magnetic material further includes an additive.

4. The ultra-low temperature regenerator according to claim 3, wherein said additive is zirconium Zr and/or aluminum Al and/or $Al_2O_3$.

5. The ultra-low temperature regenerator according to claim 1, wherein at least one type of said magnetic material is mixed with another magnetic material.

6. The ultra-low temperature regenerator according to claim 1, wherein at least two types of said magnetic material are mixed together.

7. The ultra-low temperature regenerator according to claim 1, wherein at least one type of said magnetic material is processed into granules, and then used to fill the regenerator.

8. The ultra-low temperature regenerator according to claim 1, wherein the surface of said magnetic granule is coated with a thin film, and then used to fill the regenerator.

9. The ultra-low temperature regenerator according to claim 7, wherein said granule has a size of 0.01 to 3 mm.

10. The ultra-low temperature regenerator according to claim 1, wherein at least one type of said magnetic material is sintered and processed into blocks, pellets, or plates, and then used to fill the regenerator.

11. The ultra-low temperature regenerator according to claim 1, wherein said magnetic material is formed in a layer when filling the regenerator.

12. The ultra-low temperature regenerator according to claim 1, wherein said magnetic material is used to fill a lowest temperature layer of the regenerator.

13. The ultra-low temperature regenerator according to claim 1, wherein said magnetic material is used in a higher temperature layer than a lowest temperature layer of the regenerator, and a different magnetic material with a large specific heat either in the vicinity of, or lower than 4 K is used in a lower temperature layer.

14. A regenerator type ultra-low temperature refrigerator, characterized by using the regenerator according to claim 1.

15. The regenerator type ultra-low temperature refrigerator according to claim 14, wherein said regenerator is used in a lowest temperature cooling stage.

16. The regenerator type ultra-low temperature refrigerator according to claim 14, wherein said regenerator is used in an intermediate cooling stage, and a different magnetic material with a large specific heat either in the vicinity of, or lower than 4 K is used in a regenerator of a final cooling stage.

17. The regenerator type ultra-low temperature refrigerator according to claim 14, wherein said regenerator is used in a lower temperature side cooling stage of a parallel system regenerator type ultra-low temperature refrigerator.

18. The regenerator type ultra-low temperature refrigerator according to claim 14, wherein $^4He$ is used as an operating fluid.

19. The regenerator type ultra-low temperature refrigerator according to claim 14, wherein $^3He$ is used as an operating fluid.

20. The regenerator type ultra-low temperature refrigerator according to claim 14, wherein a mixed gas of $^3He$ and $^4He$ is used as an operating fluid.

21. A refrigeration system characterized by comprising:

a precooling stage using the regenerator type ultra-low temperature refrigerator according to claim 14; and at least one other cooling means.

22. A cryogen liquefaction apparatus characterized by using the regenerator type ultra-low temperature refrigerator according to claim 14.

23. A cryogen recondensation apparatus characterized by using the regenerator type ultra-low temperature refrigerator according to claim 14.

24. A superconducting magnet equipment characterized by using the regenerator type ultra-low temperature refrigerator according to claim 14.

25. A magnetic resonance imaging (MRI) apparatus characterized by using the superconducting magnet equipment according to claim 24.

26. A superconducting device cooling equipment characterized by using the regenerator type ultra-low temperature refrigerator according to claim 14.

27. A cryopanel or a low temperature heat shield device characterized by using the regenerator type ultra-low temperature refrigerator according to claim 14.

28. A cryopump characterized by using the cryopanel according to claim 27.

29. A cooling apparatus for use in the field of space technology, characterized by using the regenerator type ultra-low temperature refrigerator according to claim 14.

30. An ultra-low temperature regenerator characterized in that at least one type of magnetic material including a rare earth element and sulfur is used as a regenerator material, wherein said magnetic material includes oxygen and wherein said magnetic material uses a material represented by a formula $R_xO_2S$ where R represents at least one type of rare earth element, with x being selected from either a first range defined as $0.1 \leqq x \leqq 2$ or a second range defined as $2<x \leqq 9$.

* * * * *